US008651329B2

(12) United States Patent
Reynolds et al.

(10) Patent No.: US 8,651,329 B2
(45) Date of Patent: Feb. 18, 2014

(54) METHODS FOR RESETTING STALLED PUMPS IN ELECTRONICALLY CONTROLLED DISPENSING SYSTEMS

(75) Inventors: Aaron R. Reynolds, North Canton, OH (US); Jackson W. Wegelin, Stow, OH (US); Robert L. Quinlan, Jr., Stow, OH (US); Robert S. Hackney, Toronto (CA); Cuong Truong, Scarborough (CA)

(73) Assignee: Gojo Industries, Inc., Akron, OH (US)

( * ) Notice: Subject to any disclaimer, the term of this patent is extended or adjusted under 35 U.S.C. 154(b) by 53 days.

(21) Appl. No.: 13/193,936

(22) Filed: Jul. 29, 2011

(65) Prior Publication Data

US 2011/0278322 A1 Nov. 17, 2011

(51) Int. Cl.

| | |
|---|---|
| ***B67D 7/14*** | (2010.01) |
| ***B67D 7/06*** | (2010.01) |
| ***B67D 3/00*** | (2006.01) |

(52) U.S. Cl.

USPC ..... 222/52; 222/23; 222/181.3; 222/504; 222/325

(58) Field of Classification Search

USPC ..... 222/41, 1, 23, 52, 63, 181.1, 181.2, 222/181.3, 321.1, 321.7, 333, 504, 62, 5, 222/402.1, 65, 325, 53

See application file for complete search history.

(56) References Cited

U.S. PATENT DOCUMENTS

| | | | | |
|---|---|---|---|---|
| 4,722,372 | A * | 2/1988 | Hoffman et al. | 141/98 |
| 5,226,566 | A * | 7/1993 | Brandenburg | 222/180 |
| 5,605,251 | A * | 2/1997 | Retti | 222/1 |
| 5,829,636 | A | 11/1998 | Vuong et al. | 222/63 |
| 5,836,482 | A | 11/1998 | Ophardt et al. | 222/325 |
| 5,908,140 | A | 6/1999 | Muderlak et al. | 222/1 |
| 6,394,310 | B1 | 5/2002 | Muderlak et al. | 222/1 |
| 6,431,400 | B1 * | 8/2002 | O'Maley et al. | 222/41 |
| 6,467,651 | B1 | 10/2002 | Muderlak et al. | 222/52 |
| 6,651,851 | B2 | 11/2003 | Muderlak et al. | 222/333 |
| 6,929,150 | B2 | 8/2005 | Muderlak et al. | 222/1 |
| 7,497,297 | B2 | 3/2009 | Watson et al. | 180/248 |
| 7,611,030 | B2 * | 11/2009 | Reynolds et al. | 222/1 |
| 7,621,426 | B2 * | 11/2009 | Reynolds et al. | 222/325 |
| 7,909,209 | B2 * | 3/2011 | Reynolds et al. | 222/41 |
| 2002/0166871 | A1 | 11/2002 | Muderlak et al. | 222/23 |
| 2005/0171634 | A1 | 8/2005 | York et al. | 700/231 |

(Continued)

FOREIGN PATENT DOCUMENTS

| | | | |
|---|---|---|---|
| EP | 1 671 568 A2 | 12/2005 | A14K 5/12 |

OTHER PUBLICATIONS

International Search Report in corresponding application No. PCT/US2012/046835 mailed Nov. 7, 2012.

(Continued)

*Primary Examiner* — Kevin P Shaver
*Assistant Examiner* — Stephanie E Williams
(74) *Attorney, Agent, or Firm* — Renner Kenner Greive Bobak Taylor & Weber

(57) ABSTRACT

A system and related method is disclosed for resetting a stalled pump in a fluid dispensing system. In one embodiment, the presence of a user's hand is detected to start a pump actuator associated with a refill container. A controller associated with a motor actuates the pump actuator by rotating a motor shaft in a first direction. The current sensor is monitored and when the current sensor detects a predetermined level of current the motor shaft is reversed to a starting position.

5 Claims, 6 Drawing Sheets

(56) References Cited

U.S. PATENT DOCUMENTS

| | | | | |
|---|---|---|---|---|
| 2005/0218161 | A1 | 10/2005 | Muderlak et al. | 222/333 |
| 2005/0247735 | A1 | 11/2005 | Muderlak et al. | 222/190 |
| 2006/0243740 | A1 | 11/2006 | Reynolds et al. | 222/52 |
| 2008/0185398 | A1 | 8/2008 | Yang et al. | 222/52 |
| 2010/0006597 | A1 | 1/2010 | Reynolds et al. | 222/41 |
| 2011/0108578 | A1 | 5/2011 | Wegelin et al. | 222/181.3 |

OTHER PUBLICATIONS

European Search Report in corresponding application No. 10189650.4 mailed Oct. 2, 2012.

* cited by examiner

METHODS FOR RESETTING STALLED PUMPS IN ELECTRONICALLY CONTROLLED DISPENSING SYSTEMS

CROSS REFERENCE TO RELATED APPLICATION

This is a continuation-in-part application of application Ser. No. 12/616,798 filed Nov. 12, 2009, which is incorporated herein by reference.

TECHNICAL FIELD

The present invention is generally directed to fluid dispensing systems. In particular, the present invention is directed to dispensers which allow only designated refill containers with dispensable material to be installed therein and, if desired, installed by selected distributors. More specifically, the present invention is directed to resetting stalled pumps used in electronically keyed fluid dispensing systems.

BACKGROUND ART

It is well known to provide fluid dispensers for use in restaurants, factories, hospitals, bathrooms and the home. These dispensers may contain fluids such as soap, anti-bacterial cleansers, disinfectants, lotions and the like. It is also known to provide dispensers with some type of pump actuation mechanism wherein the user pushes or pulls a lever to dispense a quantity of fluid into the user's hands. "Hands-free" dispensers may also be utilized wherein the user simply places their hand underneath a sensor maintained by a dispenser housing and a quantity of fluid is dispensed by a motorized pump. Related types of dispensers may be used to dispense powder, aerosol materials or paper products.

Dispensers may directly hold a quantity of fluid, but these have been found to be messy and difficult to service. As such, it is known to use refill bags or containers that hold a quantity of fluid and provide a pump and nozzle mechanism. These refill bags are advantageous in that they are easily installed without a mess. And the dispenser can monitor usage to indicate when the refill bag is low and provide other dispenser status information.

Refill containers with identifiers such as electronic or mechanical keys have been developed so as to prevent unauthorized persons from substituting inferior product into a dispensing system. Specifically, various types of mechanical or electronic keys may be used so as to associate a refill container and the fluid contained therein with a specific dispenser. Electronic keys may include, but are not limited to, magnetic sensors, optical sensors, radio frequency identification devices, and the like. In these types of dispensers, it is critical that the identifier be properly positioned or associated on the refill container and that the refill container be properly received in the dispenser housing. If an identification key is not properly positioned, then the refill container is not read by the dispensing system and is rendered inoperative. However, it is possible for the refill container to be operatively detected by the dispensing system but still installed in such a way that the pump and nozzle mechanism jams. An improperly installed refill container that stalls or jams may cause damage to the pump actuator maintained by the refill container and/or a motor assembly and associated linkage that moves the pump actuator. An improperly installed refill container or stalled pump actuator may also result in excess fluid being dispensed.

A pump actuator maintained by the dispenser housing or the pump and nozzle mechanism maintained by the refill container may jam or stall for any number of reasons. For example, the pump may be clogged by the fluid material from previous dispense cycles. Debris or other impediments may be blocking movement of the pump actuator or, as noted, the refill container may not be properly installed into a dispensing housing. For example, the pump can be installed underneath the actuator preventing operation of the dispenser and the refill container. In the past, the problem was solved by a user recognizing a stall condition and then the user correctly manually resetting the refill container within the dispenser housing. As such, the method of solving prior pump stalling events was unreliable and, unfortunately, the implemented fix may further damage the system. Therefore a need is present in the art for improved methods of resetting stalled pumps in electronically controlled dispensing systems.

SUMMARY OF THE INVENTION

In view of the foregoing it is a first aspect of the present invention to provide methods for resetting stalled pumps in electronically keyed dispensing systems.

Another aspect of the present invention, which shall become apparent as the detailed description proceeds, is achieved by a method for resetting a stalled pump in a fluid dispensing system, the method comprising detecting the presence of a user's hand to start a pump actuator associated with a refill container, monitoring a current sensor associated with a motor that actuates the pump actuator by rotating a motor shaft in a first direction, and reversing the motor shaft in a second direction to return the pump actuator to a starting position when the current sensor detects a predetermined level of current.

Yet another aspect of the present invention is to provide a dispensing system comprising a refill container filled with product, a housing adapted to accept said refill container, a pump maintained by either said refill container or said housing so as to dispense product from said refill container, wherein said pump has a loading position and a dispensing position, and a mechanism associated with said pump wherein said mechanism is configured to automatically return said pump to said loading position when a stall condition is detected.

These and other aspects of the present invention, as well as the advantages thereof over existing prior art forms, which will become apparent from the description to follow, are accomplished by the improvements hereinafter described and claimed.

BRIEF DESCRIPTION OF THE DRAWINGS

For a complete understanding of the objects, techniques and structure of the invention, reference should be made to the following detailed description and accompanying drawings, wherein.

BEST MODE FOR CARRYING OUT THE INVENTION

Figure 1:
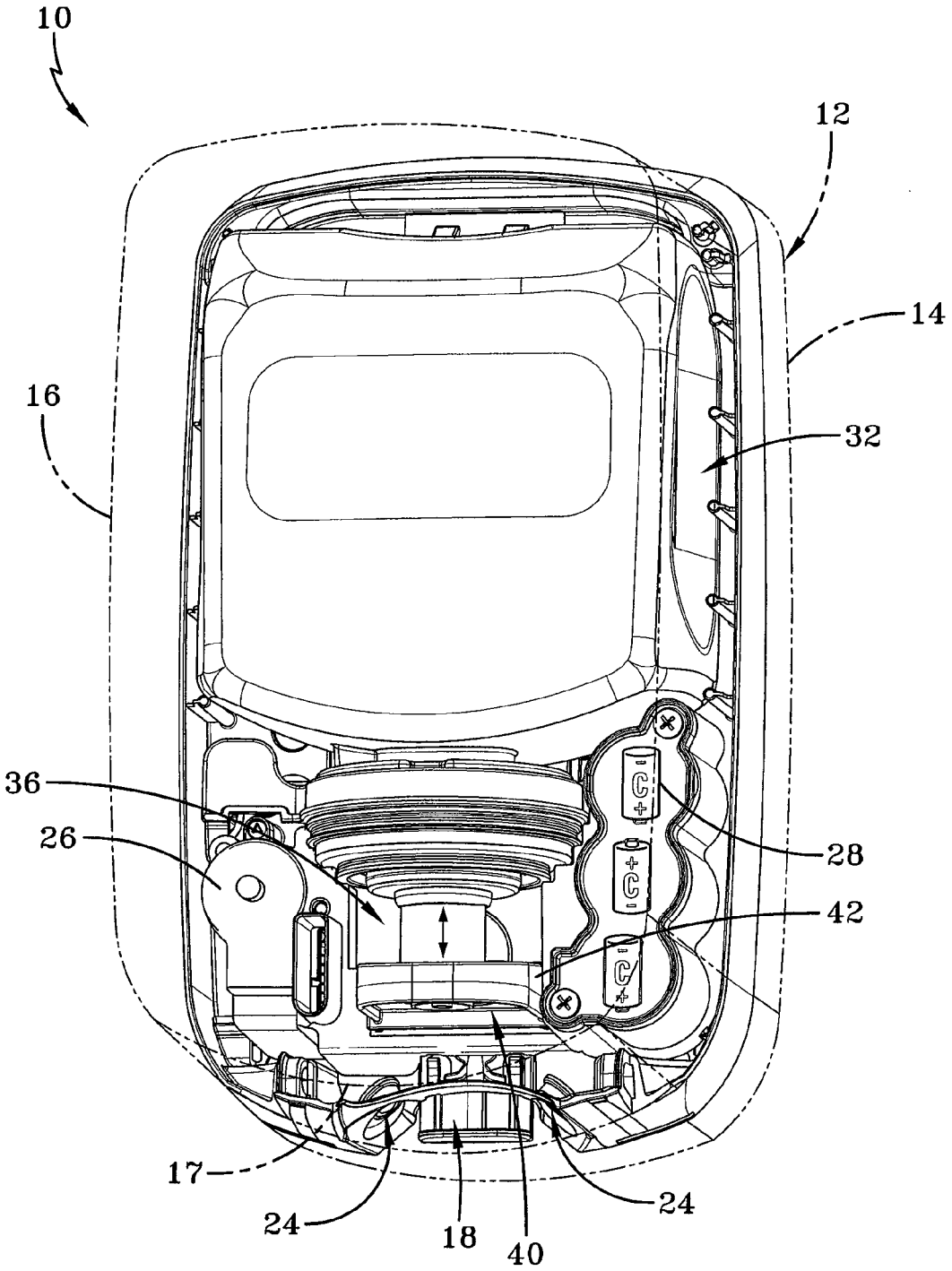
FIG. 1 is a front perspective view of an electronically controlled dispensing system made in accordance with the concepts of the present invention.
Figure 2:
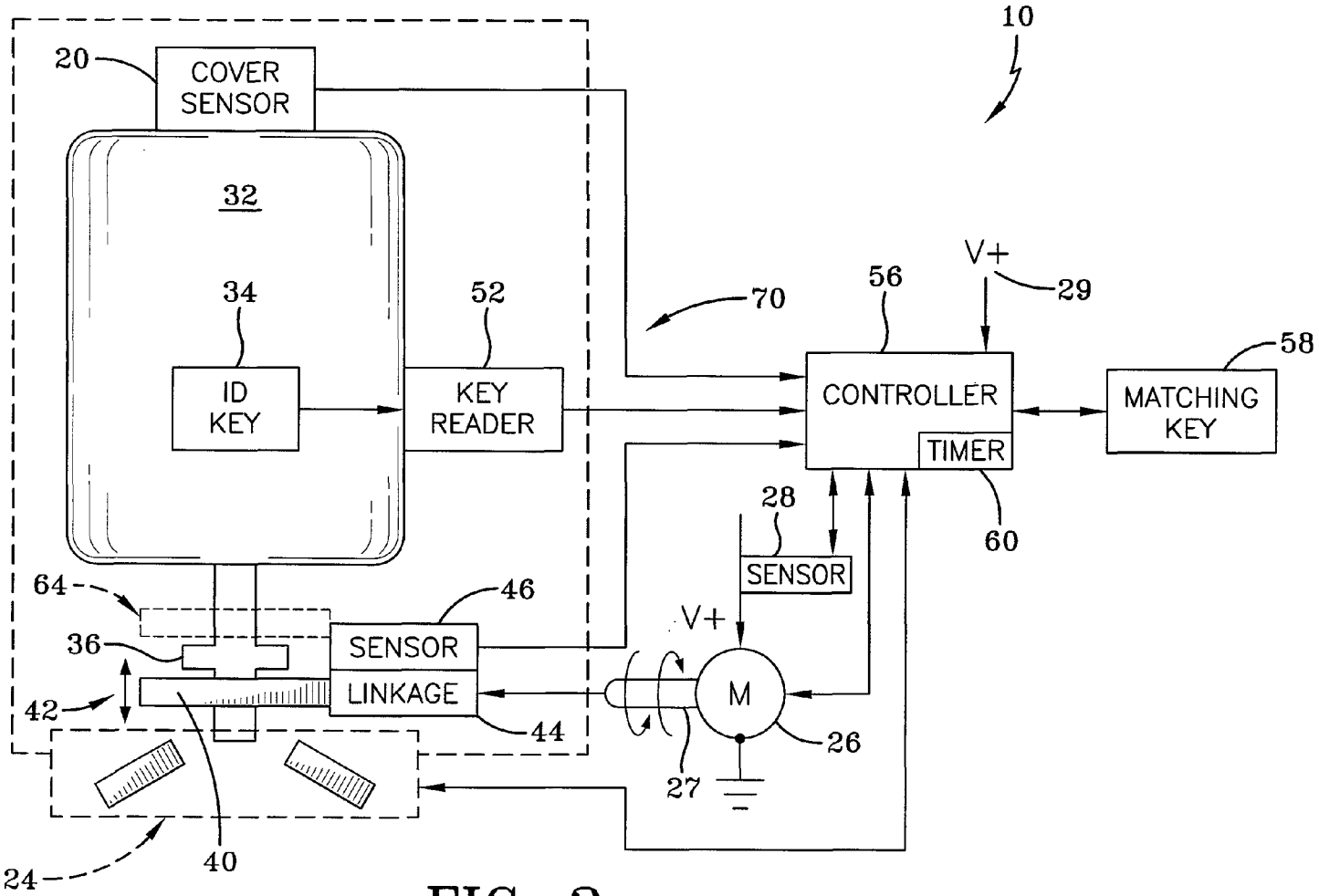
FIG. 2 is a schematic diagram of the electronically controlled dispensing system.

Referring now to the drawings, and particularly to FIGS. 1 and 2, it can be seen that a dispensing system is generally designated by the numeral 10. The dispensing system 10 includes a housing 12 which provides a back plate 14 that may be attached to a wall or other fixed surface. The housing 10 also includes a front cover 16, which is shown in phantom in FIG. 1, that is movable with respect to the back plate 14. The front cover 16 may be coupled to the back plate 14 by a hinge mechanism, deflectable detents, a frictional fit, fasteners, or the like. Although the present invention is described as a wall-mounted dispensing system, it will be appreciated that the teachings herein are applicable to a counter-mounted, stand-alone or other similar type of dispensing system. In any event, the front cover 16 includes a bottom surface 17 that provides an opening 18 so as to allow for dispensing of fluid material from the dispensing system. Associated with the front cover 16 is a cover sensor 20 which detects the position of a cover with respect to the back plate 14. In other words, the cover sensor 20 detects whenever the front cover 16 is positioned away from or separated from the back plate 14. Such an event typically occurs when the housing is opened to replace a refill container, but may also occur if the front cover is not completely seated with the back plate. A Hall effect switch, magnet sensor, optical sensor, microswitch or other similar configuration may be used for the cover sensor 20. The dispensing system also provides a hand sensor 24 near the opening 18 which detects the presence of an object such as the user's hands when they are in close proximity to the nozzle so as to initiate a dispensing event. The sensor 24 may be in the form of an infrared or ultrasonic sensor, a capacitive sensor or similar type of sensor.

The dispensing system 10 includes a motor 26 which has a rotatable shaft 27 that may either be unidirectional or reversible. In other words, in some embodiments the motor shaft may rotate in only one direction, but in other embodiments the motor shaft may be reversible such that it rotates in one direction but then changes direction if needed. A current sensor 28 is connected to the motor 26 and monitors the amount of current being drawn by the motor during operation. Power for the dispensing system 10 is provided by at least one battery 29 stored in an appropriately-sized battery compartment. The battery, which may be rechargeable, provides the necessary power and is represented by the symbol $V^+$ in FIG. 2. As will be appreciated by skilled artisans, the sensors 20 and 24 and the motor 26 are powered by the battery, as well as other components within the dispensing system as will be described.

A refill container 32 is received in the housing 12 when the front cover is open from the back cover 14. The refill container 32 carries the fluid or product to be dispensed, which may be soap, lotion, disinfectant, or any other fluid material or product as needed by a particular end use. Each refill container 32 provides an identifier key 34, also referred to as an electronic key. In the present embodiment, the identifier key is a circular wire coil wrapped around the neck of the refill container 32. A detailed explanation regarding this particular type of electronic key is provided in U.S. patent application Ser. No. 11/013,727 entitled ELECTRONICALLY KEYED DISPENSING SYSTEMS AND RELATED METHODS UTILIZING NEAR FIELD FREQUENCY RESPONSE, which is incorporated herein by reference. Briefly, the identifier key 34 is a wire coil with a capacitor attached. When the refill container 32 is properly installed in the housing, the identifier key 34 is received between two other spaced apart coils. When one of the spaced apart coils is energized, the wire coil used as the identifier key is energized and emits a coded signal specific to the capacitor. The coded signal is detected by the other spaced apart coil and then compared by a controller to a stored code. If the coded signal is acceptable, the system operates as intended. If the coded signal does not match the stored code, then the system is rendered inoperative. Skilled artisans will appreciate that other electronic, optical or mechanical keying systems could be used in place of the identifier key arrangement described above.

Extending axially from the refill container 32 is a pump 36 from which extends a nozzle. When the refill container 32 is installed into the housing, the pump is received within or otherwise coupled to a pump actuator 40 carried by the housing which moves the pump so as to dispense fluid from the refill container. The pump actuator 40 is initially in a loading position designated generally by the numeral 42 when the refill container is installed. Mechanical linkage 44, which may comprise gears of various types, interconnects the shaft 27 of motor 26 to the pump actuator 40. As such, when the motor shaft rotates in a particular direction, the linkage 44 converts the rotational motion into linear motion so as to move the pump actuator 40 in the desired direction so as to actuate the pump. An actuator sensor 46 is connected to the mechanical linkage 44 and/or the motor 26, and/or the pump actuator 40 to detect whether the pump actuator is in the loading position 42 or not. Although most embodiments provide the actuator sensor 46, it will be appreciated that in some embodiments the actuator sensor may not be provided.

A key reader is designated generally by the numeral 52 and carried by the housing 12. The reader 52, which is powered by the battery 29, detects the presence of the identifier key 34. As described above, the key reader 52 may be spaced apart wire coils or depending upon the type of identifier used, the reader 52 may be a bar code sensor, a Hall effect sensor to detect a magnet, or any sensor capable of detecting and generating an electronic signal indicating that the refill container is received within the dispensing system 10.

A controller 56, which is powered by the battery 29, is connected to and receives corresponding signals from the cover sensor 20, the hand sensor 24, the motor 26, the current sensor 28, and the actuator sensor 45 so as to control the operation thereof. The controller 56 provides the necessary hardware and software for implementing the operation of the dispensing system and any sub-routines related to detection of input or lack of input provided by the various sensors. The controller 56 maintains a matching key 58 which is compared to the electronic key associated with a refill container. In other words, the controller 56 detects the identifier key and the code associated therewith for comparison to a code associated with the matching key 58. If the code and/or keys match, then the dispensing system is enabled. However, if they do not match, then the dispensing system is disabled and rendered inoperative. A timer 60 may be connected to the controller 56, or may be incorporated within the controller as will be appreciated by those skilled in the art.

Skilled artisans will appreciate that together the motor 26, the controller 56, the sensors, the identifier key 34, the key reader 52, and the matching key, wherein the key 34 and the reader 52 may be an optical configuration, may be referred to as an electronic keying mechanism 70. The electronic keying mechanism 70, as shown in FIG. 2, also includes any components directly associated with the controller, the key and the reader and which are utilized to reset a stalled pump in an electronically controlled dispensing system. As described in the methods below, depending upon selected input from any one or combination of components included in the electronic keying mechanism, the mechanism 70 is configured to automatically return the pump to the loading position when a stall condition is detected.

In normal operation, with the refill container properly installed and detected as being an appropriate refill container for the dispensing system 10 and the front cover properly closed on the back plate 14, the controller 56 awaits a detection signal from the hand sensor 24 that an object has been properly placed underneath the opening 18. When this occurs, the controller 56 initiates rotation of the motor shaft 27 controlled by the motor 26 and the rotational motion of the shaft is converted into linear motion by the linkage 44. Movement of the linkage results in movement of the actuator 40 which in turn results in a dispensing event. During the dispensing event, the pump actuator 40 moves from a loading position 42 to an actuating position 64 (shown in phantom in FIG. 2) and then returns to the loading position via either the mechanical linkage, gravity or spring-biasing maintained within the pump.

As discussed in the Background Art, if the refill container is not properly installed with respect to the pump actuator, the system may stall, or stalls may be encountered by virtue of impediments within the system or other problems with the mechanical linkage. It will further be appreciated that upon occasion the software maintained by the controller 56 may seize and result in the pump actuator 40 not returning to the loading position. In order to address a stalled condition, several operational scenarios are disclosed herein so as to return the pump actuator 40 to a loading position so that the dispensing system properly operates.

Figure 3:
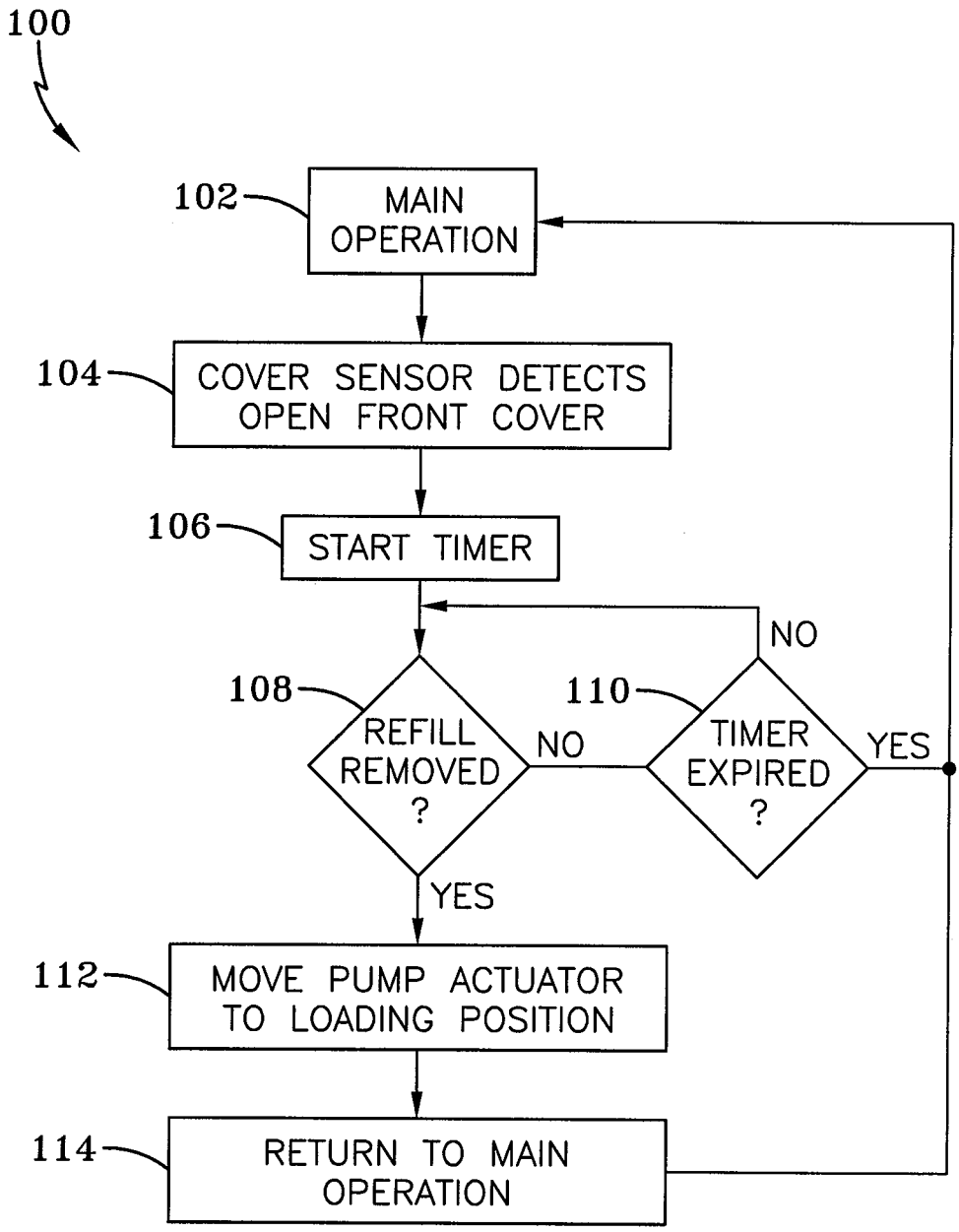
FIG. 3 is an operational flow chart of a method for resetting a stalled pump in the dispensing system.

Referring now to FIG. 3, a method for resetting a stalled pump in an electronic dispensing system is designated generally by the numeral 100. The methodology starts from a main operation routine designated by step 102. This main operation routine controls the normal operation of the dispensing system, such as the detection of the user's hands, operation of the motor in a normal operation mode, and any other programming features utilized by the dispensing system. When a stalled condition is detected, the user or technician responsible for the dispenser opens the front cover 16 which, at step 104, is detected by the cover sensor 20, which in turn sends an appropriate signal to the controller 56. At step 106, the controller starts the timer 60 to ensure that the reset process proceeds in an efficient manner. Otherwise, without benefit of the timer, the battery may be undesirably drained of power. Although any time period can be set, in an exemplary embodiment a time period of five seconds may be used. In any event, proceeding to step 108, the controller 56 determines whether the refill container 32 has been removed or not. This is done by utilizing the electronic key and the key reader 52. In other words, if the refill container and its associated electronic key is no longer detected by the key reader, then at step 110 the controller queries as to whether the timer has expired or not. If the timer has expired, then the methodology or process returns to step 102. As previously noted, use of the timer in this way prevents undesirable battery drain. However, if the timer has not expired, then the process returns to step 108 where it is presumed that the refill container will eventually be removed by the technician.

Once removal of the refill container is detected at step 108, the process continues to step 112 where the controller 56 via the motor 26 causes the pump actuator to move to the loading position 42. This resets the pump actuator 40 and then the process returns, at step 114, to the main operation procedure maintained by the dispensing system. At this time, the user would then be expected to re-install the refill container in a proper manner and, as a result, the dispensing system operates as it properly should without stalling.

In summary, the dispensing system 10 is programmed in such a way so as to automatically return the actuator to the default "loading" position 42 any time the refill container is removed from the dispensing system. Initially, the controller looks for the refill to be removed by not detecting the electronic key. Once the refill container is removed, the automatic actuator reset occurs whether or not the previous pump was stalled, thereby eliminating the need to query the positioning of the actuator to determine whether or not the pump was stalled before removal. This is advantageous in that the automatic reset of the actuator ensures that the next refill container and its pump is installed in the correct position. Such a configuration is also advantageous in that the reset function times out after a predetermined period of time when the dispenser door is open and the refill is not removed.

Figure 4:
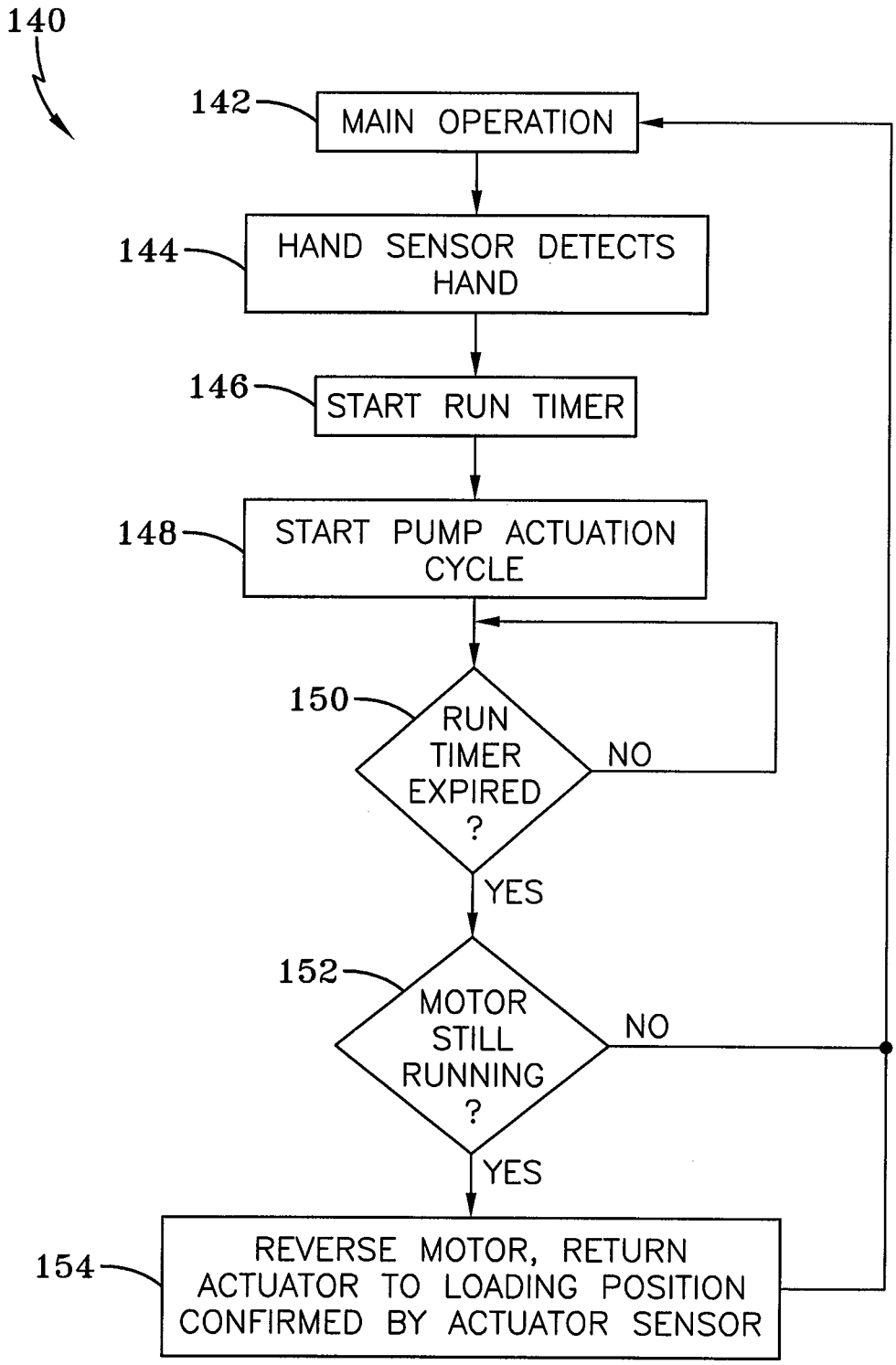
FIG. 4 is an alternative embodiment of an operational flow chart of a method for resetting a stalled pump in the dispensing system.

Referring now to FIG. 4, another methodology for resetting a stalled pump in an electronic dispensing system is designated generally by the numeral 140. In the methodology 140, a main operation is designated generally by the numeral 142. In this embodiment, the user is not required to open the front cover and the controller is configured to internally correct a stall situation. Accordingly, at step 144, the hand sensor 24 detects the presence of a user's hand and starts a run timer at step 146. Although any time period can be set, in an exemplary embodiment a time period of three seconds may be used. Subsequently, at step 148 the pump actuator cycle is started by the controller 56 so as to initiate or energize the motor 26 which moves the pump actuator 40 in a desired manner. At step 150 the controller inquires as to whether the run timer has expired or not. Step 150 allows for normal operation of the dispensing cycle. However, once the run timer has expired at step 150, then the controller inquires at step 152 as to whether the motor 26 is still running or not. If the motor is no longer running, which would be expected in normal operation, then the process proceeds to the main operation at step 142. However, if at step 152 it is determined that the motor is still running, then the process proceeds to step 154 and the controller reverses rotation of the motor shaft 27 so as to return the actuator to the loading position 42. Confirmation that the actuator has returned to the loading position is confirmed by a signal generated by the sensor 46. Upon completion of the return of the pump actuator to the loading position, the operation returns to step 142.

The above-described resetting method is advantageous in that a technician is not required to open the housing and remove the refill container and then re-install a new container. By utilizing a maximum run time function (steps 146 and 150), which times the actuation of the pump, it can be easily determined whether a stall has occurred. If a stall does occur, then the pump undesirably continues to actuate for a longer period of time. To correct this situation the rotation of the motor shaft is reversed causing the actuator to re-position. This embodiment utilizes the actuator sensor 46 which is connected to the controller 56 to monitor the position of the actuator via the linkage so as to ensure that the actuator returns to the loading position.

Figure 5:
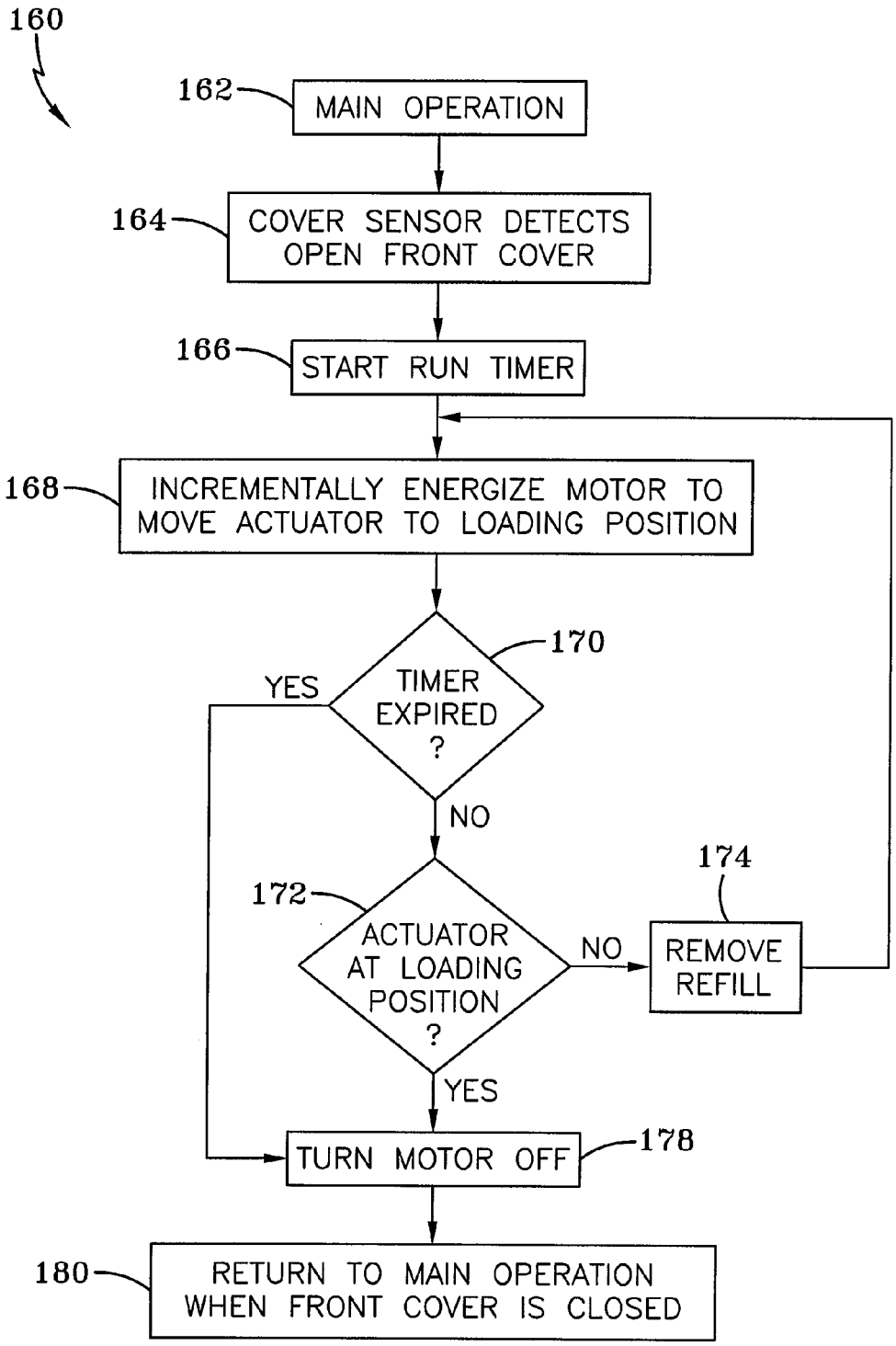
FIG. 5 is another alternative embodiment of an operational flow chart of a method for resetting a stalled pump in the dispensing system.

In yet another embodiment shown in FIG. 5, a methodology is designated generally by the numeral 160. A main operation step 162 is also provided in this embodiment and a cover sensor 20 detects when the front cover is opened at step 164. When this occurs, a timer is started at step 166, and following this the motor is incrementally energized to move the actuator to the loading position at step 168. Although any time period can be set, in an exemplary embodiment a time period of five seconds may be used. In this embodiment, the motor shaft is uni-directional. In other words, the motor is not reversible.

At step 170 the controller inquires as to whether the timer has expired or not. If the timer has not expired then at step 170 the controller inquires as to whether the actuator is at the loading position or not as determined by the actuator. If it is determined that the actuator is not at the loading position, then the methodology at step 174 requires the user to remove the refill container. Upon completion of step 174 the methodology returns to step 168 and the motor is incrementally energized to move the actuator, and steps 170 and 172 are repeated. If at step 170 it is determined that the timer is expired, then the controller turns the motor off at step 178. Alternatively, if at step 170 it is determined that the timer has not expired, but that the actuator is at the loading position at step 172, then the motor is turned off. Upon completion of step 178 the process, at step 180, returns to main operation when the front cover is closed as determined by the sensor 20.

This methodology is advantageous in that the dispensing system can be configured to automatically jog or rotate the motor shaft upon opening of the front cover. The motor then gives power somewhat continuously until the actuator is returned to the proper position. If the pump is stalled, the actuator will not return to its loading position until the stalled pump and refill container are removed. If the pump is not stalled, then the motor shaft rotates and then shuts off since the actuator is in the correct position from the last cycle of the pump actuator. Regardless of whether the pump was stalled or not, the actuator would be left in the proper position to accept a new refill container. The timer feature prevents battery drain.

Figure 6:
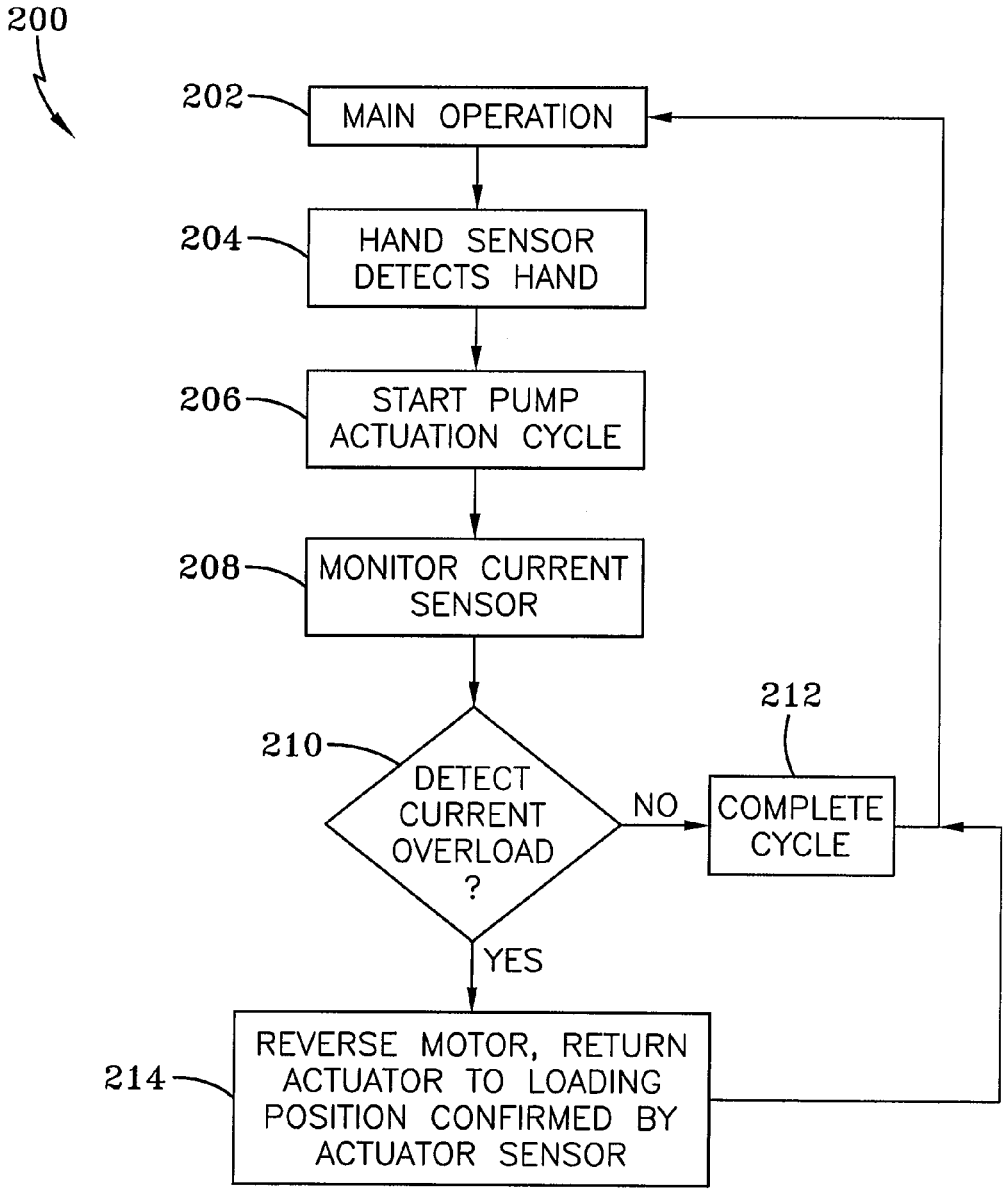
FIG. 6 is yet another embodiment of an operational flow chart of a method for resetting stalled a pump in the dispensing system.

In still another embodiment shown in FIG. 6, a methodology is designated generally by the numeral 200. A main operation step 202 is also provided in this embodiment, but in contrast to the other embodiments, does not require the opening of a cover. Instead, at step 204, the hand sensor 24 detects the presence of an object such as a user's hand. When this occurs, at step 206 a pump actuation cycle is started. This is initiated by the controller 56 receiving an indication of the presence of an object by the sensor 24 and initiating rotation of the reversible shaft 27 by the motor 26. As in the previous embodiments, rotation of the shaft engages the linkage 44 and begins actuation of a dispensing cycle. During the dispensing cycle, the controller 56 monitors the current sensor 28 to detect the amount of current drawn by the motor 26. At step 210 the controller periodically monitors the amount of current drawn by the motor as determined by the sensor 28. If the sensor 28 does not detect a current overload or other abnormality at step 210, then at step 212 the controller 56 continues with the dispensing cycle operation at step 212 and upon completion thereof returns the operation to the main operation step 202.

However, if at step 210 a current overload or other motor operating abnormality is detected such as by detecting a predetermined level of current or any amount of current over the predetermined level of current, then the controller 56 instructs the motor 26 to reverse the rotational direction of the shaft 27 so as to return the actuator, via the linkage 44 from an actuating or other intermediate position, to a loading position as determined by the position sensor 46. Upon completion of step 214 the process returns to the main operation at step 202.

This methodology is advantageous in that the system can be configured to automatically reverse motor direction upon detection of the motor drawing an abnormal or excess amount of current. It is presumed that the drawing of an abnormal amount of current is an indication that there is some type of interference with the linkage mechanism and/or the pump actuator 40 that prevents a full completion of an operational cycle. Such a feature does not require the use of a cover sensor or key reader component as in the other embodiments and provides a simpler method of reversing a stalled pump in comparison to the other embodiments while still providing the same desired benefits.

Accordingly, based on the foregoing methodologies it will be appreciated that various scenarios can be utilized to reset the pump actuator to a loading position so that a stalled pump can be easily corrected without damage to the refill container or the occurrence of undesired dispensing events. This saves on loss of fluid from the refill container and also prevents possible damage to the operating mechanism of the dispensing system.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A method for resetting a stalled pump in a fluid dispensing system, the method comprising:

detecting the presence of a user's hand to start a pump actuator associated with a refill container;

monitoring a current sensor associated with a motor that actuates said pump actuator by rotating a motor shaft in a first direction; and reversing said motor shaft in a second direction to return said pump actuator to a starting position when said current sensor detects a predetermined level of current.

2. The method according to claim 1, further comprising:

sensing a position of said pump actuator with a position sensor; and stopping reversal of said motor shaft in said second direction when said pump actuator returns to a loading position.

3. The method according to claim 2, further comprising:

completing a dispense cycle by said pump actuator if said current sensor does not detect said predetermined level of current.

4. A dispensing system comprising:

a refill container filled with product;

a housing adapted to accept said refill container;

a pump maintained by either said refill container or said housing so as to dispense product from said refill container, wherein said pump has a loading position and a dispensing position; and a mechanism associated with said pump wherein said mechanism is configured to automatically return said pump to said loading position when a stall condition is detected.

5. The system according to claim 4, wherein said mechanism comprises a controller connected to said pump;

a hand sensor connected to said controller;

a motor with a reversible shaft, said motor connected to said controller and engageable with said pump; and a current sensor associated with said motor and connected to said controller;

wherein if said hand sensor detects an object, said controller starts said pump through said motor by rotating said shaft in a first direction, and said controller rotates said reversible shaft in an opposite direction to return said pump to said loading position if said current sensor detects a predetermined level of current.

* * * * *